US007256808B2

(12) United States Patent
Vicktorius

(10) Patent No.: US 7,256,808 B2
(45) Date of Patent: Aug. 14, 2007

(54) PRINTING DEVICE

(75) Inventor: Winfried Vicktorius, Duisburg (DE)

(73) Assignee: Espera-Werke GmbH, Duisburg (DE)

( * ) Notice: Subject to any disclaimer, the term of this patent is extended or adjusted under 35 U.S.C. 154(b) by 0 days.

(21) Appl. No.: 10/561,585

(22) PCT Filed: Jun. 16, 2004

(86) PCT No.: PCT/EP2004/006450

§ 371 (c)(1),
(2), (4) Date: Dec. 19, 2005

(87) PCT Pub. No.: WO2004/110770

PCT Pub. Date: Dec. 23, 2004

(65) Prior Publication Data

US 2006/0139435 A1 Jun. 29, 2006

(30) Foreign Application Priority Data

Jun. 18, 2003 (DE) ..... 103 27 745

(51) Int. Cl.
*B41J 25/312* (2006.01)

(52) U.S. Cl. ..... 347/198; 400/120.17

(58) Field of Classification Search ..... 347/197, 347/198; 400/120.16, 120.17
See application file for complete search history.

(56) References Cited

U.S. PATENT DOCUMENTS 6,118,468 A 9/2000 Ando et al.

FOREIGN PATENT DOCUMENTS

| | | |
|---|---|---|
| EP | 0738606 | 10/1996 |
| JP | 03-270964 | * 12/1991 |
| JP | 6099642 | 4/1994 |

* cited by examiner

*Primary Examiner*—Huan Tran
(74) *Attorney, Agent, or Firm*—Alfred A. Fressola; Ware, Fressola, Van Der Sluys & Adolphson LLP

(57) ABSTRACT

The invention relates to a printing device for printing sheet elements (1) that are serially fed to the printing device, in particular product labels made of temperature-sensitive paper or paper substitute materials, comprising a feed device for feeding the sheet elements to a print head which acts on the sheet element, wherein the print head comprises a thermal slat (3) which is supported flexibly by a carrier device (8) such that between the thermal slat (3) and the deflection device (4) a counterpressure surface is formed at a predefined surface pressure on the sheet element (1) to be printed. The thermal slat (3) is associated with an adaptor means (7) that is exchangeable together with the thermal slat (3).

5 Claims, 1 Drawing Sheet

PRINTING DEVICE

CROSS REFERENCE TO RELATED APPLICATIONS

This application is for entry into the U.S. national phase under §371 for International Application No. PCT/EP2004/006450 having an international filing date of Jun. 16, 2004, and from which priority is claimed under all applicable sections of Title 35 of the United States Code including, but not limited to, Sections 120, 363 and 365(c) and which in turn claims priority under 35 U.S.C. §119 to German Patent Application DE10327745.5 filed on Jun. 18, 2003.

TECHNICAL FIELD

The invention relates to a printing device for printing sheet elements that are serially fed to the printing device, which sheet elements comprise a surface material, in particular product labels made of temperature-sensitive paper or paper substitute materials, comprising a feed device for feeding the sheet elements to a print head which acts on the sheet element, wherein said print head comprises a thermal slat which is supported flexibly by a carrier device such that between the thermal slat and the sheet element a counter-pressure surface is formed at a predefined surface pressure on the sheet element to be printed.

BACKGROUND OF THE INVENTION

Such a printing device is known from DE 100 22 152 A1. This is a printing device that is designed as a thermal printer in which the thermal slat prints the temperature-sensitive labels by local heating. With this known type of printer, product labels of different widths can be printed, wherein the width of the thermal slat has to be adapted to the maximum width of the label to be printed.

From DE 41 39 445 A1 a print head is known which is pretensioned using a multitude of springs that are provided between the print head and end stops of movable shanks.

From DE 33 15 947 A1 a print device is known in which the print head, which comprises the printing plate and a heater for heating the printing plate, is connected to an operating device that is movable in the opposite direction and that comprises elastic elements in the form of leaf springs.

In printing devices of the type mentioned in the introduction it is crucial that the surface pressure between the active area of the thermal slat and the label to be printed always remains the same so as to ensure good print quality. On the other hand the thermal slat, due to its contact with the surface of labels, is subject to wear and tear which limits the service life of the thermal slat. In particular when labels are printed whose width is considerably less than the width of the thermal slat, the printing device operates in an uneconomical manner because wear and tear in this region leads to failure of the thermal slat although the outer zone of said thermal slat is still functional. Moreover, wider thermal slats are of course more expensive than narrower ones.

SUMMARY OF THE INVENTION

Based on the above, it is the object of the invention to improve a device of the type mentioned in the introduction such that more effective use of the thermal slat becomes possible while the print quality remains unchanged.

According to the invention this object is met in that the thermal slat is associated with an adaptor means that is exchangeable together with said thermal slat, with which adaptor means the excursion of the resilient holding means for the thermal slat can be adjusted such that the surface pressure is constant irrespective of the width of the thermal slat.

The solution according to the invention is characterised in that different thermal slats, whose widths match the width of the sheet elements to be labelled, can be used easily and without any further adjustment measures. An adaptor means is provided which can be exchanged together with the thermal slat, which adaptor means is designed such that during printing of the sheet element the surface pressure remains constant irrespective of the width of the respective thermal slat, without there being a need for adjustment measures.

A preferred embodiment of the solution according to the invention provides for adaptation of the surface pressure such that depending on the width of the thermal slat in use, the thickness of the adaptor means is varied. This is achieved in that in the case of a wider width of the thermal slat the excursion of the resilient suspension of the thermal slat is greater, while correspondingly in the case of a narrower width of the thermal slat the excursion is less, so that the surface pressure remains constant irrespective of the width of the thermal slat.

According to a preferred embodiment of the invention this can be achieved with a design that provides for spacers of different thicknesses to be associated with thermal slats of different widths, wherein such spacers are exchanged together with the thermal slat.

As an alternative, it is also possible to provide a design in which spacer pins are used, with their length being such that the desired surface pressure can be set by way of the excursion of the spring suspension.

BRIEF DESCRIPTION OF THE DRAWINGS

A further variant of the invention provides for the thermal slat to comprise electrical, optical or mechanical identification means that interact with the actuators that alter the excursion of the spring such that the desired excursion is set according to the width of the thermal slat. This can, for example, be achieved in that electric coding takes place in the electronics that are associated with the thermal slat, which coding serves as the control value for the actuator. In this arrangement the position of the excursion is set piezo-electrically, pneumatically, by way of a motor drive or hydraulically.

The solution according to the invention can preferably be applied to sheet elements in the form of product labels. Such product labels can either be product labels that are removably affixed to a liner strip, which product labels are removable from the liner by means of a so-called peeling-off device, or they can be linerless labels or continuous material. Furthermore, it is possible to use thermotransfer print labels in which the print image is transferred from an intermediate medium to the label by heating the thermal slat.

Figure 2:
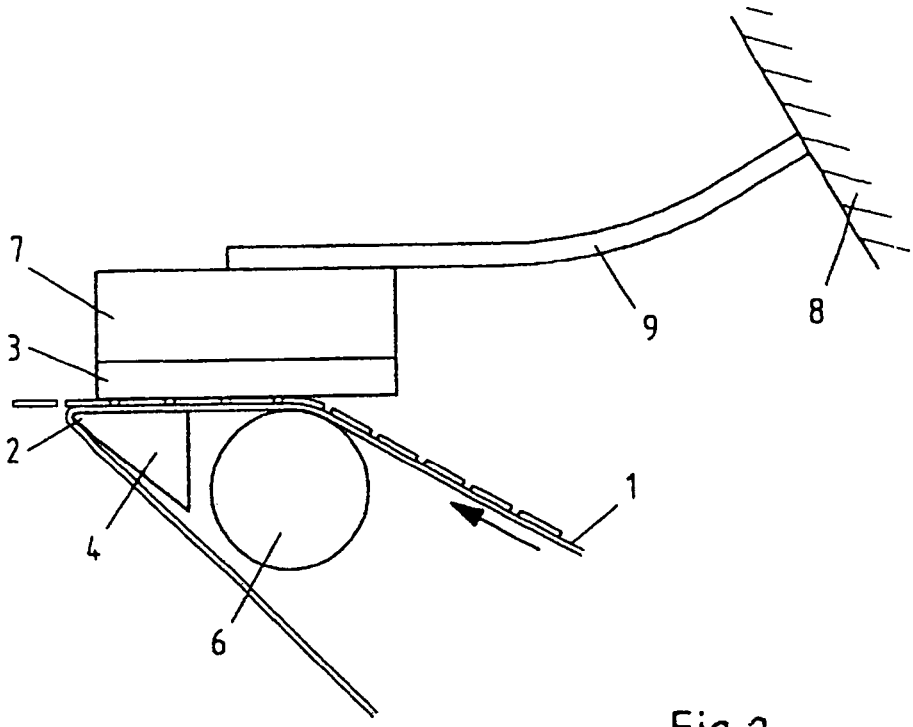
Figure 1:
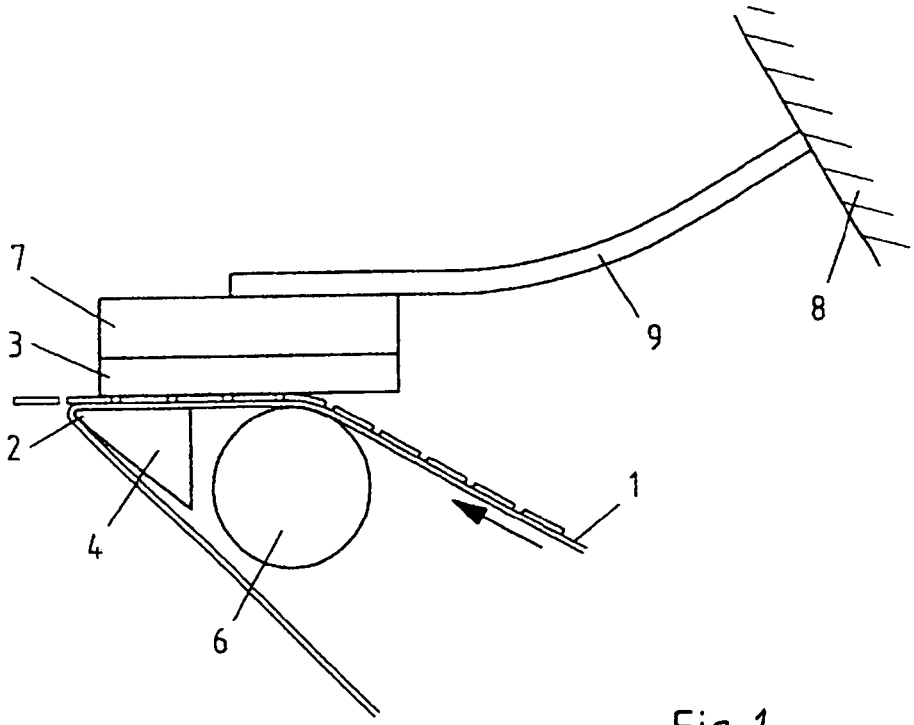

Below, the invention is explained in more detail with reference to a drawing that shows but one embodiment, as follows:

FIG. 1 an embodiment of the invention for use with a thermal slat of narrower width; and FIG. 2 the embodiment of the invention for use with a thermal slat of wider width.

DETAILED DESCRIPTION

The printing device shown in FIG. 1 is used for printing sheet elements in the form of product labels, which sheet elements are fed from a feed unit (not shown) in the form of a take-off reel. The sheet elements in the form of product labels 1 made of temperature-sensitive paper are first fed to a print drum 6 that forms a counterpressure surface, and subsequently move along the top of a deflection device 4. After this they reach the front edge 2 formed at the deflection device 4.

Above the deflection device 4 a stationary carrying element 8 is provided, on which by way of a sprung holding device 9 an adaptor plate 7 is arranged, with a thermal slat 3 being attached to said adaptor plate 7.

The unit comprising the thermal slat 3 and the adaptor plate 7 can be locked or removed using locking means (not shown) in the upper part of the printing device shown.

In this arrangement each set comprising the adaptor plate 7 and the thermal slat 3 is designed such that a wide thermal slat 3 is associated with an adaptor plate 7 of greater thickness, while a narrower thermal slat is associated with an adaptor plate of lesser thickness. FIG. 1 thus shows a first slide-in set comprising a thermal slat of narrower width and an adaptor plate of lesser thickness; and in contrast to this, FIG. 2 shows a wider thermal slat in combination with an adaptor plate of greater thickness.

This matching, according to the invention, of the width of the thermal slat to the thickness of the adaptor plate results in a situation in which, in the region of the support surface, the surface pressure acting on the product label 1 to be printed is always the same.

The invention claimed is:

1. A printing device for printing sheet elements (1) that are serially fed to the printing device, which sheet elements comprise a surface material, in particular product labels made of temperature-sensitive paper or paper substitute materials, comprising a feed device for feeding the sheet elements (1) to a print head which acts on the sheet element (1), wherein said print head comprises a thermal slat (3) which is supported flexibly by a carrier device (8) such that between the thermal slat (3) and the sheet element (1) a counterpressure surface is formed at a predefined surface pressure on the sheet element (1) to be printed, characterised in that the thermal slat (3) is associated with an adaptor means (7) that is exchangeable together with said thermal slat (3), with which adaptor means (7) the excursion of a resilient holding means (9) for the thermal slat (3) can be adjusted such that the surface pressure is constant irrespective of the width of the thermal slat (3).

2. The printing device according to claim 1, characterised in that the adaptor means (7) is an actuator, by way of which the excursion of the holding means (9) is controllable.

3. The printing device according to claim 2, characterised in that the actuator is controllable piezoelectrically, by way of a motor drive, pneumatically, or hydraulically.

4. The printing device according to claim 1, characterised in that the adaptor means (7) is a spacer affixed to the thermal slat (3), wherein the thickness of said spacer is proportional to the width of the thermal slat (3).

5. The printing device according to claim 1, characterised in that the adaptor means (7) is a pin element affixed to the thermal slat (3), wherein the length of said pin element is proportional to the width of the thermal slat (3).

* * * * *

UNITED STATES PATENT AND TRADEMARK OFFICE

CERTIFICATE OF CORRECTION

PATENT NO. : 7,256,808 B2
APPLICATION NO. : 10/561585
DATED : August 14, 2007
INVENTOR(S) : Vicktorius It is certified that error appears in the above-identified patent and that said Letters Patent is hereby corrected as shown below:

At column 2, line 38, please remove the heading "BRIEF DESCRIPTION OF THE DRAWINGS".

At column 2, line 60, please insert the heading --BRIEF DESCRIPTION OF THE DRAWINGS--.

Signed and Sealed this

Eleventh Day of March, 2008

JON W. DUDAS
*Director of the United States Patent and Trademark Office*